US010190491B2

(12) United States Patent
Nakamura et al.

(10) Patent No.: US 10,190,491 B2
(45) Date of Patent: Jan. 29, 2019

(54) INTERNAL COMBUSTION ENGINE

(71) Applicant: Nissan Motor Co., Ltd., Yokohama-shi, Kanagawa (JP)

(72) Inventors: Katsutoshi Nakamura, Kanagawa (JP); Masayoshi Tsubokawa, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 15/570,247

(22) PCT Filed: Apr. 3, 2015

(86) PCT No.: PCT/JP2015/060607
§ 371 (c)(1),
(2) Date: Oct. 27, 2017

(87) PCT Pub. No.: WO2016/157521
PCT Pub. Date: Oct. 6, 2016

(65) Prior Publication Data
US 2018/0142618 A1 May 24, 2018

(51) Int. Cl.
*F02B 75/04* (2006.01)
*F02B 75/32* (2006.01)
*F02D 15/02* (2006.01)

(52) U.S. Cl.
CPC ..... *F02B 75/048* (2013.01); *F02B 75/04* (2013.01); *F02B 75/045* (2013.01); *F02B 75/32* (2013.01); *F02D 15/02* (2013.01); *F02D 2700/03* (2013.01)

(58) Field of Classification Search
CPC ..... F02B 75/045; F02B 75/048; F02B 75/32; F02D 15/02; F02D 2700/03
USPC ..... 123/48 B, 78 E, 78 BA
See application file for complete search history.

(56) References Cited

U.S. PATENT DOCUMENTS

2006/0180118 A1 8/2006 Takemura et al.
2007/0250249 A1* 10/2007 Okubo ..... G01L 3/245 701/103
2010/0101053 A1 4/2010 Li et al.
2015/0377120 A1* 12/2015 Hiyoshi ..... F02D 15/02 123/48 B

FOREIGN PATENT DOCUMENTS

CN 1127331 A 7/1996
CN 101725626 A 6/2010
JP 2005083203 A 3/2005
(Continued)

*Primary Examiner* — Marguerite McMahon
(74) *Attorney, Agent, or Firm* — Young Basile Hanlon & MacFarlane, P.C.

(57) ABSTRACT

When a stopper portion is brought into abutment against body high-compression-ratio side stopper portion, when viewed in the control shaft axial direction, it is configured that the distance between body high-compression-ratio side stopper surface and control-shaft high-compression-ratio side stopper surface becomes relatively longer as being closer to the control shaft rotation center. Similarly, when a stopper portion is brought into abutment against body low-compression-ratio side stopper portion, when viewed in the control shaft axial direction, the distance between body low-compression-ratio side stopper surface and control-shaft, low-compression-ratio side stopper surface becomes relatively longer as being closer to the control shaft rotation center.

4 Claims, 7 Drawing Sheets

(56) References Cited

FOREIGN PATENT DOCUMENTS

| | | | |
|---|---|---|---|
| JP | 2006226133 | A | 8/2006 |
| JP | 2009185629 | A | 8/2009 |
| JP | 2011169152 | A | 9/2011 |
| RU | 2256085 | C2 | 7/2005 |
| RU | 2338079 | C1 | 11/2008 |

* cited by examiner

INTERNAL COMBUSTION ENGINE

TECHNICAL FIELD

The present invention relates to an internal combustion engine with a variable compression ratio mechanism capable of varying the compression ratio according to the rotational position of the control shaft.

BACKGROUND

In a compression ratio variable device that is capable of varying the compression ratio by changing the combustion chamber volume of the internal combustion engine according to the rotational position of the control shaft, Japanese Patent Application Publication 2006-226133 discloses a structure in which rotation of the control shaft is limited by bringing a control-shaft-side stopper member, which is fixed on the control shaft, into abutment against a body-side stopper member, which is fixed on the cylinder block.

For example, in a structure to limit rotation of the control shaft by bringing a stopper surface of the body-side stopper member into abutment against a stopper surface of the control-shaft-side stopper member, there occurs a change of the position where the control-shaft-side stopper member is brought into abutment against the body-side stopper member, depending on variation of the control-shaft-side and body-side stopper members' shapes etc.

Herein, when the control-shaft-side stopper member has been brought into abutment against the body-side stopper member, provided that the rotational torque of the control shaft is constant, loads generated on both become greater as their abutment occurs at a position closer to the rotation center of the control shaft, when viewed in the axial direction of the control shaft.

That is, depending on variation of the body-side and control-shaft-side stopper members' shapes etc., the control-shaft-side stopper member is brought into a one-sided abutment against the body-side stopper member at a position that is relatively close to the rotation center of the control shaft when viewed in the axial direction of the control shaft, thereby causing a risk that a load to be generated on both of the body-side stopper member and the control-shaft-side stopper member becomes relatively large.

An internal combustion engine of the present invention has a variable compression ratio mechanism that is capable of continuously varying compression ratio of the internal combustion engine according to the rotational position of the control shaft, and a body-side stopper that limits rotation of the control shaft. The control shaft is equipped with a control-shaft-side stopper that is brought into abutment against the body-side stopper. The control-shaft-side stopper has a control-shaft-side stopper surface that is brought into abutment against the body-side stopper. The body-side stopper has a body-side stopper surface that is brought into abutment against the control-shaft-side stopper. When the control-shaft-side stopper is brought into abutment against the body-side stopper, the distance between the body-side stopper surface and the control-shaft-side stopper surface is configured to become longer on the control shaft rotation center side when viewed in the axial direction of the control shaft.

According to the present invention, even if both of the body-side stopper surface and the control side stopper surface have variation in their shapes etc., when the control-shaft-side stopper surface is brought into abutment against the body-side stopper surface, it is possible to prevent the control-shaft-side stopper surface from being brought into abutment against the body-side stopper surface at a position that is relatively close to the control shaft rotation center, when viewed in the axial direction of the control shaft. Therefore, it is possible to prevent loads, which are generated on both of the body-side stopper portion and the control-shaft-side stopper portion, from becoming relatively large, when the control-shaft-side stopper portion has been brought into abutment against the body-side stopper portion.

DETAILED DESCRIPTION OF THE EMBODIMENTS

In the following, an embodiment of the present invention is explained in detail with reference to the drawings.

Figure 1:
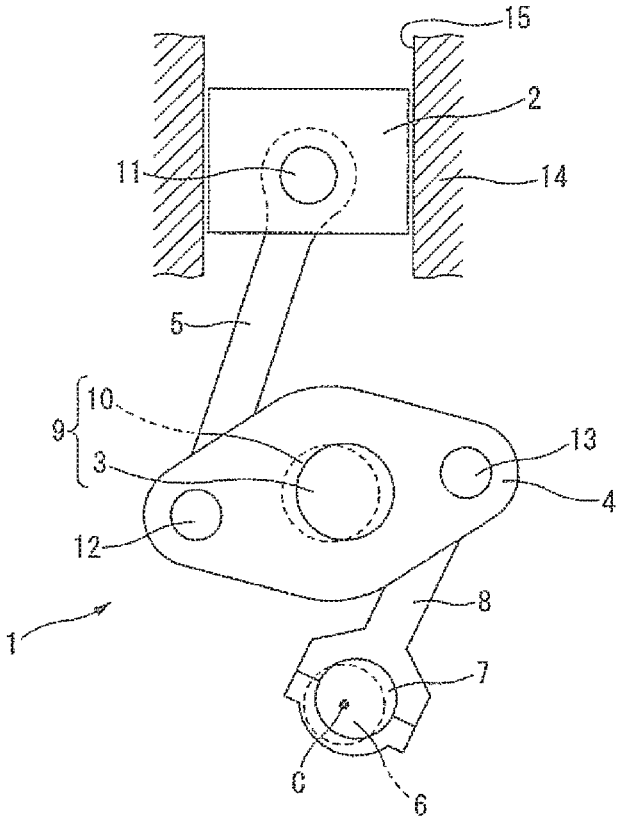
FIG. 1 is an explanatory view schematically showing an outline structure of a variable compression ratio mechanism with which an internal combustion engine according to the present invention is equipped.

FIG. 1 is an explanatory view schematically showing an outline structure of a variable compression ratio mechanism with which an internal combustion engine according to the present invention is equipped.

Variable compression ratio mechanism 1 is a multilink-type piston crank mechanism and is one changing the engine compression ratio by changing the top dead center position of piston 2.

This variable compression ratio mechanism 1 has lower link 4 that is rotatably attached to crankpin 3, upper link 5 that connects this lower link 4 and piston 2, control shaft 6 provided with eccentric shaft portion 7, and control link 8 that connects eccentric shaft portion 7 and lower link 4.

Crankshaft 9 is equipped with a plurality of journal portions 10 and crankpins 3. Crankpin 3 is eccentric by a predetermined amount relative to journal portions 10, and lower link 4 is rotatably attached to this.

Upper link 5 is rotatably connected at its one end to piston 2 through piston pin 11 and is rotatably connected at the other end to one end portion of lower link 4 through first connecting pin 12.

Control link 8 is rotatably connected at its one end to the other end portion of lower link 4 through second connecting pin 13 and is rotatably connected at the other end to eccentric shaft portion 7.

Sign 14 in FIG. 1 designates a cylinder block, and sign 15 in FIG. 1 designates a cylinder in which piston 2 reciprocates.

Figure 2:
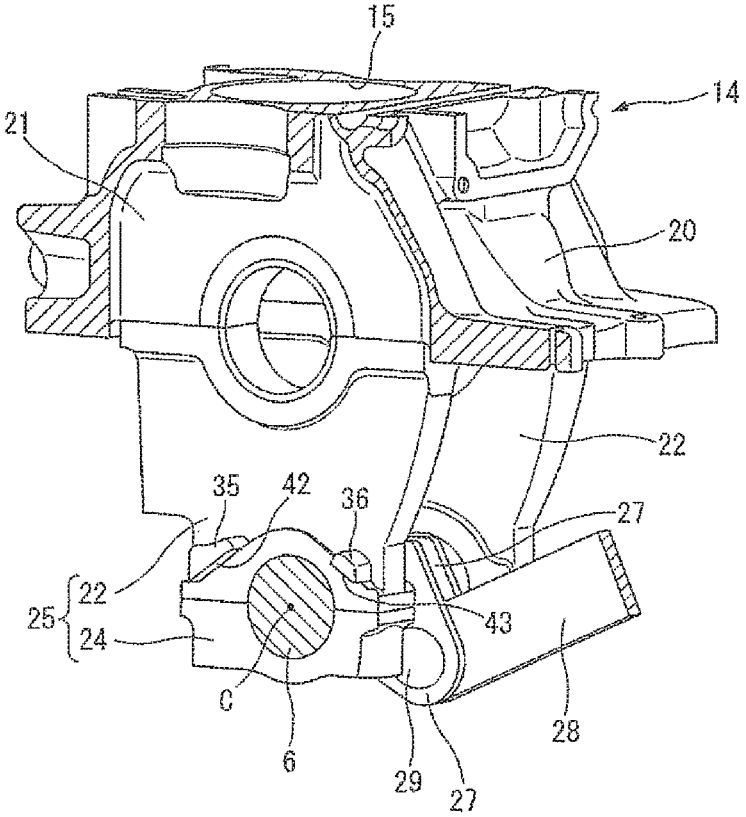
FIG. 2 is an explanatory view schematically showing outlines of bearing parts of the crankshaft and the control shaft.

FIG. 2 is an explanatory view schematically showing outlines of bearing parts of crankshaft 9 and control shaft 6. In this FIG. 2, an upper part of cylinder block is omitted.

Figure 3:
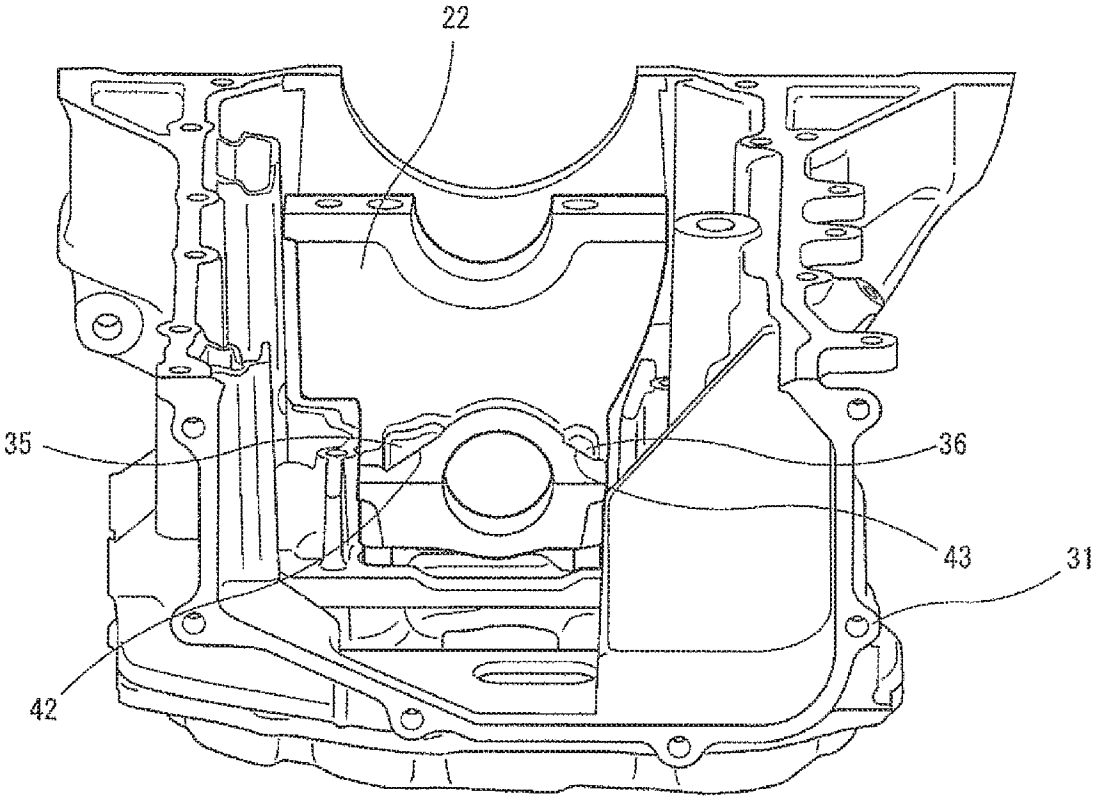
FIG. 3 is a perspective view showing an oil pan and the bearing part of the control shaft.

Variable compression ratio mechanism 1 is accommodated in a crankcase constructed of skirt portion 20 of cylinder block 14 and oil pan shown in FIG. 3.

A lower part of cylinder block 14 is partitioned by bulkheads 21 that are positioned between cylinders and at both ends in the cylinders line direction. For example, when the internal combustion engine has four cylinders, cylinder block 14 has five bulkheads 21.

Journal portion 10 of crankshaft 9 is rotatably supported by a crankshaft bearing portion that is constructed of this bulkhead 21 and main bearing cap 22. That is, crankshaft 9 is rotatably supported on both sides in the cylinders line direction of crankpin 3 of each cylinder by bulkheads 21 and main bearing caps 22.

Figure 4:
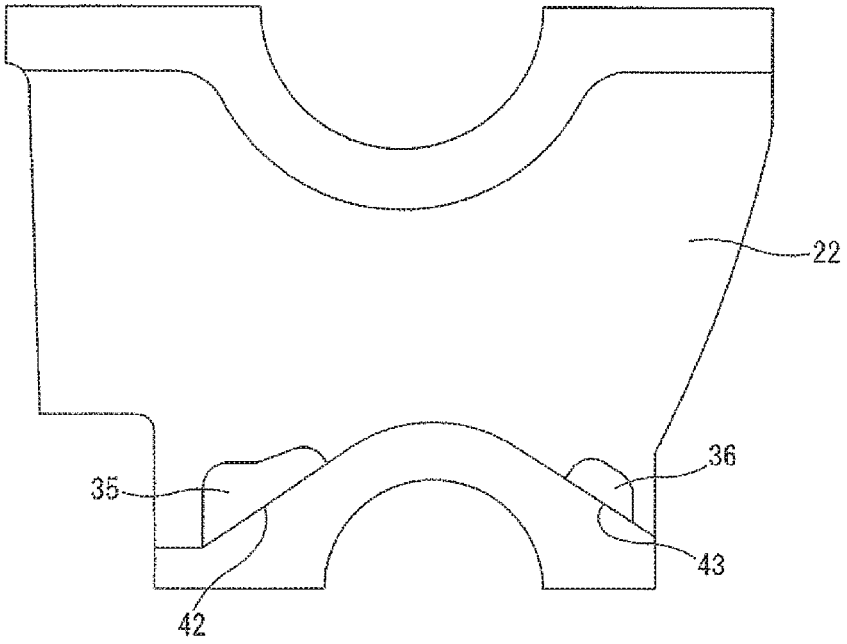
FIG. 4 is a front view showing a main bearing cap provided with the body-side stopper.

As shown in FIG. 2 to FIG. 4, body high-compression-ratio side stopper portion 35 and body low-compression-ratio side stopper portion 36 as body side stoppers are projectingly formed on a side surface on the side, where stopper member 37 is positioned, of main bearing cap 22, which is adjacent to stopper member 37, of main bearing caps 22. Body high-compression-ratio side stopper portion 35 and body low-compression-ratio side stopper portion 36 are formed at a position where they are spaced away from each other on both sides of control shaft 6, when viewed in the control shaft axial direction.

Sub bearing cap 24 is fixed to a lower part of main bearing cap 22 by bolts (not shown in the drawings).

Control shaft 6 is rotatably supported on control shaft bearing portion 25 constructed of main bearing cap 22 and sub bearing cap 24.

Figure 5:
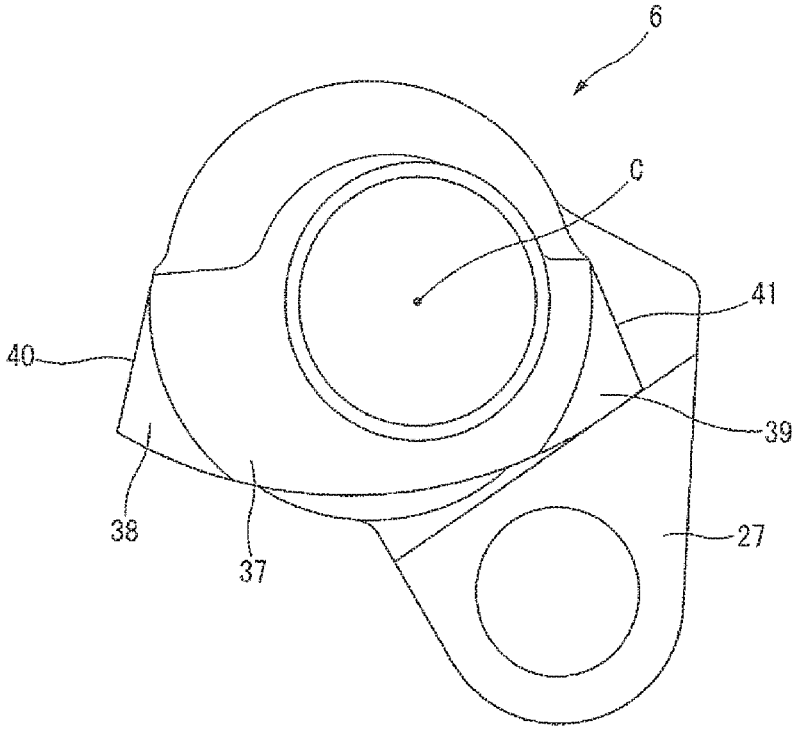
FIG. 5 is a front view showing the control shaft.

Control shaft 6 is formed at its predetermined position in the axial direction with a pair of arm portions 27, 27 projecting outward in the control shaft radial direction. As shown in FIG. 5, stopper member 37 as a control-shaft-side stopper is fixed at a predetermined position in the axial direction of control shaft 6.

To arm portions 27, 27, one end of elongate link member 28 is rotatably connected through connecting pin 29.

Link member 28 is connected with an actuator (not shown in the drawings) positioned outside of oil pan 31 and reciprocates along a direction perpendicular to the crankshaft axis. Control shaft 6 rotates by a transmission of the reciprocating movement of link member 28 through arm portions 27, 27. The actuator may be, for example, either an electric motor or a hydraulically-operated actuator.

Stopper member 37 is brought into abutment against body high-compression-ratio side stopper portion 35 or body low-compression-ratio side stopper portion 36, which is formed on main bearing cap 22, thereby limiting rotation of control shaft 6.

Stopper member 37 is generally sectorial in shape. It has control-shaft, high-compression-ratio side stopper portion 38 that is brought into abutment against body high-compression-ratio side stopper portion 35 to limit rotation of control shaft 6 toward the high compression ratio side, and control-shaft, low-compression-ratio side stopper portion 39 that is brought into abutment against body low-compression-ratio side stopper portion 36 to limit rotation of control shaft 6 toward the low compression ratio side. Control-shaft, high-compression-ratio side stopper portion 38 and control-shaft, low-compression-ratio stopper portion 39 are formed at a position where they are spaced away from each other in the control shaft circumferential direction.

Control-shaft, high-compression-ratio side stopper portion 38 is formed with control-shaft, high-compression-ratio side stopper surface 40 as a control-shaft-side stopper surface that is brought into abutment against body high-compression-ratio side stopper portion 35.

Furthermore, control-shaft, high-compression-ratio side stopper portion 38 is formed such that thickness along the control shaft radial direction of a portion, which is brought into abutment against body high-compression-ratio side stopper portion 35, becomes relatively thick, and projects as a whole in a generally triangular shape when viewed in the control shaft axial direction.

Control-shaft, low-compression-ratio side stopper portion 39 is formed with control-shaft, low-compression-ratio side stopper surface 41 as a control-shaft-side stopper surface that is brought into abutment against body low-compression-ratio side stopper portion 36.

Furthermore, control-shaft, low-compression-ratio side stopper portion 39 is formed such that thickness along the control shaft radial direction of a portion, which is brought into abutment against body low-compression-ratio side stopper portion 36, becomes relatively thick, and projects as a whole in a generally triangular shape when viewed in the control shaft axial direction.

Body high-compression-ratio side stopper portion 35 and body low-compression-ratio side stopper portion 36 are formed to be spaced away from each other on both sides of control shaft 6.

Body high-compression-ratio side stopper portion 35 has body high-compression-ratio side stopper surface 42 as a body-side stopper surface against which control-shaft, high-compression-ratio side stopper surface 40 of stopper member 37 is brought into abutment.

Body high-compression-ratio side stopper portion 35 is formed such that thickness of a portion against which control-shaft, high-compression-ratio side stopper portion 38 is brought into abutment becomes relatively thick when viewed in the control shaft axial direction. In other words, body high-compression-ratio side stopper portion 35 is formed such that its thickness becomes relatively thicker as the distance from control shaft rotation center C becomes longer in the control shaft axial direction.

Body low-compression-ratio side stopper portion 36 has body low-compression-ratio side stopper surface 43 as a body-side stopper surface against which control-shaft, low-compression-ratio side stopper surface 41 of stopper member 37 is brought into abutment.

In this variable compression ratio mechanism 1, rotation of control shaft 6 changes the center position of eccentric shaft portion 7, thereby changing a swing support position of the other end of control link 8. When the swing support position of control link 8 changes, stroke of piston 2 in cylinder 15 changes. Thus, position of piston 2 at the piston top dead center (TDC) becomes high or low. With this, it becomes possible to vary the engine compression ratio.

Furthermore, it is possible to learn the reference position on the high compression ratio side of control shaft 6 by bringing control-shaft, high-compression-ratio side stopper portion 38 of stopper member 37 into abutment against body high-compression-ratio side stopper portion 35. Furthermore, it is possible to learn the reference position on the low compression ratio side of control shaft 6 by bringing control-shaft, low-compression-ratio side stopper portion 39 of stopper member 37 into abutment against body low-compression-ratio side stopper portion 36.

In a structure where rotation of control shaft 6 is limited by bringing control-shaft, high-compression-ratio side stopper surface 40 of stopper member 37 into abutment against body high-compression-ratio side stopper surface 42 formed on body high-compression-ratio side stopper portion 35 or by bringing control-shaft, low-compression-ratio side stopper surface 41 of stopper member 37 into abutment against body low-compression-ratio side stopper surface 43 formed on body low-compression-ratio side stopper portion 36, positions of body side stopper surfaces 42, 43 against which control-shaft side stopper surfaces 40, 41 are brought into abutment change depending on variation of each stopper surface 40, 41, 42, 43 shape etc.

When control-shaft, high-compression-ratio side stopper surface 40 has been brought into abutment against body high-compression-ratio side stopper surface 42, provided that the rotational torque of control shaft 6 is constant, loads generated on both of body high-compression-ratio side stopper portion 35 and stopper member 37 become greater as their abutment occurs at a position closer to control shaft rotation center C.

When control-shaft, low-compression-ratio side stopper surface 41 has been brought into abutment against body low-compression-ratio side stopper surface 43, provided that the rotational torque of control shaft 6 is constant, loads generated on both of body low-compression-ratio side stopper portion 36 and stopper member 37 become greater as their abutment occurs at a position closer to control shaft rotation center C.

Figure 6A:
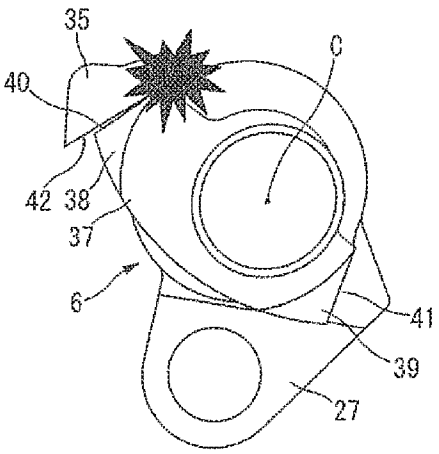
FIG. 6 are explanatory views schematically showing manner of abutment between the body-side stopper and the control-shaft-side stopper, wherein (a) shows a case of one-sided abutment at a position close to the control shaft rotation center, (b) shows a case of surface contact, and (c) shows a case of one-sided abutment at a position far from the control shaft rotation center.
Figure 6B:
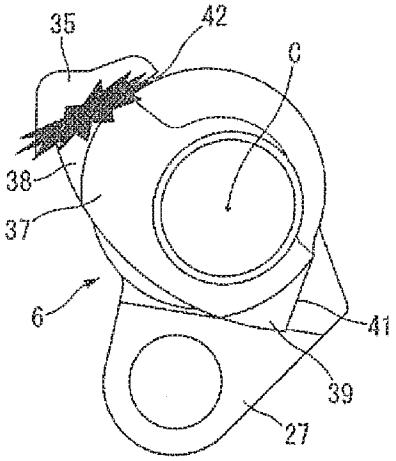
Figure 6C:
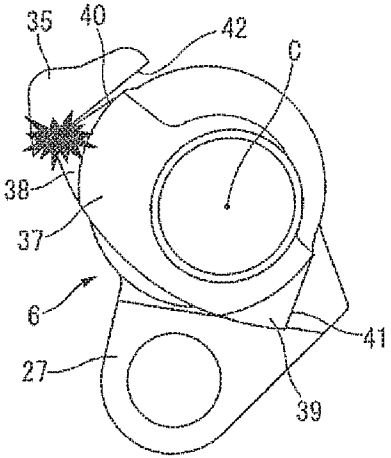

For example, as shown in FIG. 6, when control-shaft, high-compression-ratio side stopper surface 40 is brought into abutment against body high-compression-ratio side stopper surface 42, when viewed in the control shaft axial direction, as compared with a case (FIG. 6*b*) that there occurs a surface contact without a one-sided abutment between body high-compression-ratio side stopper surface 42 and control-shaft, high-compression-ratio side stopper surface 40 or a case (FIG. 6*c*) that control-shaft, high-compression-ratio side stopper surface 40 is brought into a one-sided abutment against body high-compression-ratio side stopper surface 42 at a position that is relatively far from control shaft rotation center C, in a case (FIG. 6*a*) that control-shaft high-compression-ratio side stopper surface 40 is brought into a one-sided abutment against body high-compression-ratio side stopper surface 42 at a position that is relatively close to control shaft rotation center C, the arm length of torque becomes shorter. Therefore, provided that rotational torque of control shaft 6 is constant, at the abutment, loads generated on both of body high-compression-ratio side stopper portion 35 and stopper member 37 become relatively large.

In a case that there occurs a surface contact without a one-sided abutment between body high-compression-ratio side stopper surface 42 and control-shaft, high-compression-ratio side stopper surface 40, when viewed in the control shaft axial direction, the distance between control shaft rotation center C and the contact position of both can be considered to become relatively longer than in a case that control-shaft, high-compression-ratio side stopper surface 40 is brought into a one-sided abutment against body high-compression-ratio side stopper surface 42 at a position that is relatively close to control shaft rotation center C and can be considered to become relatively shorter than in a case that control-shaft, high-compression-ratio side stopper surface 40 is brought into a one-sided abutment against body high-compression-ratio side stopper surface 42 at a position that is relatively far from control shaft rotation center C.

Figure 7:
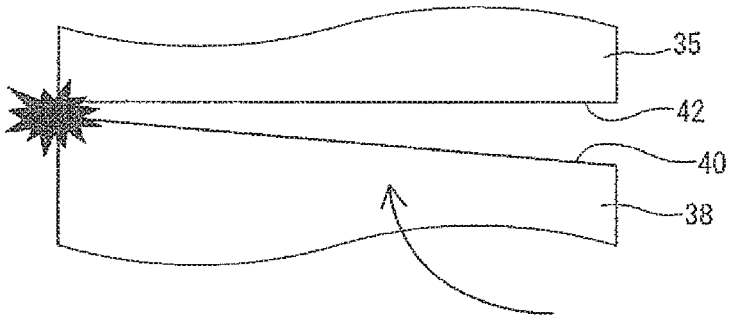
FIG. 7 is an explanatory view schematically showing a configuration of the body-side stopper surface and the control-shaft-side stopper surface.

Thus, in the present embodiment, as shown in FIG. 7, when control-shaft, high-compression-ratio side stopper portion 38 is brought into abutment against body high-compression-ratio side stopper portion 35, when viewed in the control shaft axial direction, it is configured that the distance between body high-compression-ratio side stopper surface 42 and control-shaft, high-compression-ratio side stopper surface 40, which are opposed to each other, becomes relatively longer as being closer to the side of control shaft rotation center C. Similarly, when control-shaft, low-compression-ratio side stopper portion 39 is brought into abutment against body low-compression-ratio side stopper portion 36, when viewed in the control shaft axial direction, it is configured that the distance between body low-compression-ratio side stopper surface 43 and control-shaft, low-compression-ratio side stopper surface 41, which are opposed to each other, becomes relatively longer as being closer to the side of control shaft rotation center C.

In other words, when stopper member 37 is brought into abutment against body high-compression-ratio side stopper portion 35, when viewed in the control shaft axial direction, it is configured that control-shaft, high-compression-ratio side stopper surface 40 is brought into a one-sided abutment against body high-compression-ratio side stopper surface 42 on a side that is far from control shaft rotation center C. Furthermore, when stopper member 37 is brought into abutment against body low-compression-ratio side stopper surface 43, when viewed in the control shaft axial direction, it is configured that control-shaft, low-compression-ratio side stopper surface 41 is brought into a one-sided abutment against body low-compression-ratio side stopper surface 43 on a side that is far from control shaft rotation center C.

With this, even if both of body high-compression-ratio side stopper surface 42 and control-shaft, high-compression-ratio side stopper surface 40 have variation in their shapes etc., when viewed in the control shaft axial direction, it is possible to prevent control-shaft, high-compression-ratio side stopper surface 40 from being brought into a one-sided abutment against body high-compression-ratio side stopper surface 42 at a position that is relatively close to control shaft rotation center C. Therefore, it is possible to prevent loads, which are generated on both of body high-compression-ratio side stopper portion 35 and stopper member 37, from becoming relatively large. Furthermore, even if both of body low-compression-ratio side stopper surface 43 and control-shaft, low-compression-ratio side stopper surface 41 have variation in their shapes, etc., when viewed in the control shaft axial direction, it is possible to prevent control-shaft low-compression-ratio side stopper surface 41 from being brought into a one-sided abutment against body low-compression-ratio side stopper surface 43 at a position that is relatively close to control shaft rotation center C. Therefore, it is possible to prevent loads, which are generated on both of body low-compression-ratio side stopper portion 36 and stopper member 37, from becoming relatively large.

Since control-shaft high-compression-ratio side stopper portion 38 and control-shaft, low-compression-ratio side stopper portion 39 are formed to be spaced from each other in the control shaft circumferential direction, it is possible to configure control-shaft high-compression-ratio side stopper portion 38 and control-shaft, low-compression-ratio side stopper portion 39 with the minimum necessary sizes at necessary positions. That is, it becomes possible to make stopper member 37 have a small size, as compared with a structure in which control-shaft high-compression-ratio side stopper portion 38 and control-shaft, low-compression-ratio side stopper portion 39 are projectingly formed as a single stopper portion. Therefore, it becomes possible to make the entirety of stopper member 37 have a light weight.

Control-shaft, high-compression-ratio side stopper portion 38 is formed such that thickness along the control shaft radial direction of a portion that is brought into abutment against body high-compression-ratio side stopper portion 35 becomes relatively thick. Therefore, it is possible to make control-shaft, high-compression-ratio side stopper portion 38 have a necessary strength by setting thickness along the control shaft radial direction at the minimum necessary thickness.

Control-shaft, low-compression-ratio side stopper portion 39 is formed such that thickness along the control shaft radial direction of a portion that is brought into abutment against body low-compression-ratio side stopper portion 36 becomes relatively thick. Therefore, it is possible to make control-shaft, low-compression-ratio side stopper portion 39 have a necessary strength by setting thickness along the control shaft radial direction at the minimum necessary thickness.

Body high-compression-ratio side stopper portion 35 is formed such that, when viewed in the control shaft axial direction, thickness of a portion that becomes in contact, when control-shaft, high-compression-ratio side stopper portion 38 has been brought into abutment thereagainst, becomes relatively thick. Therefore, it is possible to improve body high-compression-ratio side stopper portion 35 in strength when control-shaft, high-compression-ratio side stopper portion 38 has been brought into abutment thereagainst.

Body low-compression-ratio side stopper portion 36 may also be formed such that, when viewed in the control shaft axial direction, thickness of a portion against which control-shaft, low-compression-ratio side stopper portion 39 is brought into abutment becomes relatively thick. That is, body low-compression-ratio side stopper portion 36 may also be formed such that, when viewed in the control shaft axial direction, thickness becomes relatively greater as the distance from control shaft rotation center C becomes longer.

Furthermore, in the above-mentioned embodiment, on both of high compression ratio side and low compression ratio side, it is configured that the distance between the stoppers when they are brought into abutment becomes relatively longer as being closer to control shaft rotation center C. However, on either one of them, it may be configured that the distance between the stoppers when they are brought into abutment becomes relatively longer as being closer to control shaft rotation center C.

For example, only on a side where frequency of the reference position learning of control shaft 6 is high, or only on low compression ratio side which receives cylinder pressure load in case that the compression ratio cannot be maintained by failure of the actuator to rotate control shaft 6, it may be configured that the distance between the stoppers when they are brought into abutment becomes relatively longer as being closer to control shaft rotation center C.

The above-mentioned embodiment has a structure where control shaft 6 has stopper member 37 as a separate member fixed thereto. It is, however, optional to machine forged control shaft 6 to have a control-shaft side stopper.

The invention claimed is:

1. An internal combustion engine comprising a variable compression ratio mechanism that is capable of continuously varying compression ratio of the internal combustion engine according to rotational position of a control shaft, and a body-side stopper that limits rotation of the control shaft, wherein the control shaft is equipped with a control-shaft-side stopper that is brought into abutment against the body-side stopper, wherein the control-shaft-side stopper has a control-shaft-side stopper surface that is brought into abutment against the body-side stopper, wherein the body-side stopper has a body-side stopper surface that is brought into abutment against the control-shaft-side stopper, wherein, when the control-shaft-side stopper is brought into abutment against the body-side stopper, the control-shaft-side stopper and the body-side stopper form an abutment portion and a portion opposite the abutment portion, wherein a distance between the body-side stopper surface and the control-shaft-side stopper surface increases toward the portion opposite the abutment portion, and wherein the portion opposite the abutment portion is at a position closer to a rotation center of the control shaft when viewed in an axial direction of the control shaft than the abutment portion.

2. The internal combustion engine as claimed in claim 1, wherein the control-shaft-side stopper comprises a control-shaft, high-compression-ratio side stopper portion that limits displacement of the control shaft toward a high compression ratio side, and a control-shaft, low-compression-ratio side stopper portion that limits displacement of the control shaft toward a low compression ratio side, wherein the control-shaft, high-compression-ratio side stopper portion and the control-shaft, low-compression-ratio side stopper portion are formed to be spaced away from each other in a circumferential direction of the control shaft.

3. The internal combustion engine as claimed in claim 1, wherein the control-shaft-side stopper is formed such that a thickness of a first portion of the control-shaft-side stopper, which is brought into abutment against the body-side stopper, along a radial direction of the control shaft is thicker than a second portion of the control-shaft-side stopper that is opposite the first portion.

4. The internal combustion engine as claimed in claim 1, wherein a thickness of a first portion of the body-side stopper that is positioned away from the rotation center of the control shaft is thicker than a second portion of the body-side stopper that is positioned proximate the rotation center of the control shaft.

* * * * *